US005799574A

United States Patent [19]

Williams et al.

[11] Patent Number: 5,799,574

[45] Date of Patent: Sep. 1, 1998

[54] SPINDLE DISC FOR HIGH SPEED CAN DECORATORS

[75] Inventors: Robert Williams, Randolph; Chester Chrobocinski, Carteret; Andre Christopher Rodums, West Milford, all of N.J.

[73] Assignee: Sequa Corporation, Hackensack, N.J.

[21] Appl. No.: 876,409

[22] Filed: Jun. 16, 1997

[51] Int. Cl.[6] ..... B41F 17/08

[52] U.S. Cl. ..... 101/40; 101/38.1

[58] Field of Search ..... 101/40, 39, 40.1, 101/38.1

[56] References Cited

U.S. PATENT DOCUMENTS

| | | | |
|---|---|---|---|
| 3,227,070 | 1/1966 | Brigham et al. | 101/40 |
| 3,567,043 | 3/1971 | Sirvet et al. | 214/1 |
| 3,586,175 | 6/1971 | Gauld | 214/1 |
| 3,766,851 | 10/1973 | Sirvet et al. | 101/40 |
| 3,996,851 | 12/1976 | Urban | 101/40 |
| 4,048,917 | 9/1977 | Skrypek et al. | 101/40 |
| 4,140,053 | 2/1979 | Skrypek et al. | 101/40 |
| 4,337,719 | 7/1982 | Griendt et al. | 118/46 |
| 4,498,387 | 2/1985 | Stirbis | 101/40 |
| 4,771,879 | 9/1988 | Shriver | 198/471.1 |
| 4,921,093 | 5/1990 | Peters et al. | 198/471.1 |
| 5,111,742 | 5/1992 | DiDonato et al. | 101/40 |
| 5,186,100 | 2/1993 | Turturro et al. | 101/40 |
| 5,572,927 | 11/1996 | Sirvet | 101/40 |
| 5,609,100 | 3/1997 | Williams | 101/40 |

*Primary Examiner*—Edgar S. Burr
*Assistant Examiner*—Dave A. Ghatt
*Attorney, Agent, or Firm*—Mitchell D. Bittman; Jerome Berliner

[57] ABSTRACT

A mandrel/spindle disc for a continuous motion can decorator includes a plurality of relatively lightweight mandrel assemblies mounted on a rotating carrier with equal angular spacings between adjacent assemblies. The assemblies reciprocate radially with respect to the carrier axis as a center. Each assembly includes a base and two guide rods that extend radially inward from the base and are received by sleeve bushings that are disposed in radial holes extending inward from the carrier periphery. A plurality of relatively small grease pools are formed by small transverse holes, each of which extend forward from the rear of the carrier disc to engage the inner ends of four bushing holes. Vacuum and air pressure are fed to each mandrel assembly through a flexible hose having a large loop therein. The base of the assembly is made compact so that when decorations are being applied to a particular can the mandrel supporting that particular can moves relatively close to the radially outward end of the bushings thereby reducing bending moments acting between the assembly guide shafts and their bushings. These bushings extend radially outward of the carrier periphery, being received by undercuts in washer-like retainers that are piloted on the bushings to help position sealing rings that are mounted under the inside of the retainers.

20 Claims, 9 Drawing Sheets

SPINDLE DISC FOR HIGH SPEED CAN DECORATORS

BACKGROUND OF THE INVENTION

This invention relates generally to apparatus for applying decorations to cylindrical containers and in particular relates to a spindle carrier disc for a continuous motion high speed apparatus of that type.

Incorporated herein by reference are the teachings of U.S. Pat. No. 3,766,851 issued Oct. 23, 1973 to E. Sirvet et al for Continuous Can Printer and Handling Apparatus, U.S. Pat. No. 4,140,053 issued Feb. 20, 1979 to J. Skrypek et al for Mandrel Mounting and Trip Mechanism for Continuous Motion Decorator and U.S. Pat. No. 5,111,742 issued May 12, 1992 to R. DiDonato et al for Mandrel Trip Subassembly for Continuous Motion Can Decorators.

U.S. Pat. No. 3,766,851 discloses relatively high speed apparatus for applying decorations to the exterior of cylindrical containers while they are mounted on mandrels or spindles which are disposed along the periphery of a large continuously rotating disc-like carrier. Decorations are applied to the containers by having same engage a rotating blanket of a decorator that is adjacent the periphery of the carrier. During engagement between the containers and the decorating blanket, the containers track the blanket surface through the region where the containers and blanket surface are engaged. To accomplish this tracking, for each angular position of the container measured about the axis of the spindle disc as a center, a device controlled by a closed loop or box cam maintains the container in a precise radial position relative to the axis of the spindle disc.

This type of decorating equipment includes some relatively heavy elements that move at high speed. Because there must be precise coordination between the various elements, inertia forces, lubrication and operating power are significant engineering design considerations, as are equipment downtime, maintenance costs and setup procedures.

SUMMARY OF THE INVENTION

In accordance with the instant invention, each of the mandrels or spindles is part of an individual spindle assembly that includes an L-shaped base which must be relatively rigid in order to properly position the cantilevered spindle while decorations are being applied to the container carried thereby. To accomplish this, the instant invention substantially reduces the weight of the spindle assembly base without sacrificing rigidity.

In addition, bending moments that must be resisted by the cantilevered spindle are substantially reduced by reducing the spacing between the spindle axis and the rods that extend from the base to guide the spindle assembly as it reciprocates radially. This serves to reduce stress on the bushings wherein the guide rods reciprocate so that bushing wear is reduced. As will hereinafter be seen, improved lubrication is also provided between the guide rods and their bushings.

Many spindle discs of the prior art were provided with a large chamber from which lubricant was withdrawn and pumped through longitudinal passages in the radial guide rods of the spindle assemblies.

To reduce weight of the spindle disc the large chamber for the large lubrication pool, required in many prior art spindle discs, has been eliminated. Instead, a plurality of relatively small interconnected lubrication chambers are provided. This serves to strengthen the spindle disc. That is, in the prior art so much material was removed to form the large lubrication chamber that disc strength had to be restored by providing a relatively heavy, large thick steel cover for the chamber. In contrast, the multiple relatively small lubrication chambers of the instant invention are interconnected by an annular slot of small cross-section. Such slot is formed without substantially reducing the strength of the spindle disc so that a lightweight aluminum cover is satisfactory for closing the connecting slot and small lubrication chambers.

Accordingly, the primary object of the instant invention is to provide an improved high speed continuous motion cylindrical container decorator having substantially reduced maintenance and power requirements.

Another object is to provide a decorator of this type wherein substantial weight reductions have been achieved for the disc-like carrier and reciprocating spindle subassemblies carried thereby.

Still another object is to provide a construction for this type of decorator to simplify setup procedures and reduce the likelihood that there will be lubrication points that have not been treated properly or have been overlooked completely.

A further object is to eliminate telescoping shaft and bushing connections in the air/vacuum lines.

A still further object is to provide a spindle disc construction wherein a hose having a single complete loop therein is used to connect a radially reciprocating spindle assembly to a radially fixed point on the spindle disc.

Yet another object is to provide a spindle disc construction in which hose connections are made by fittings that do not have moving parts.

These objects as well as other objects of this invention shall become readily apparent after reading the following description of the accompanying drawings in which:

DETAILED DESCRIPTION OF THE INVENTION

Figure 1:
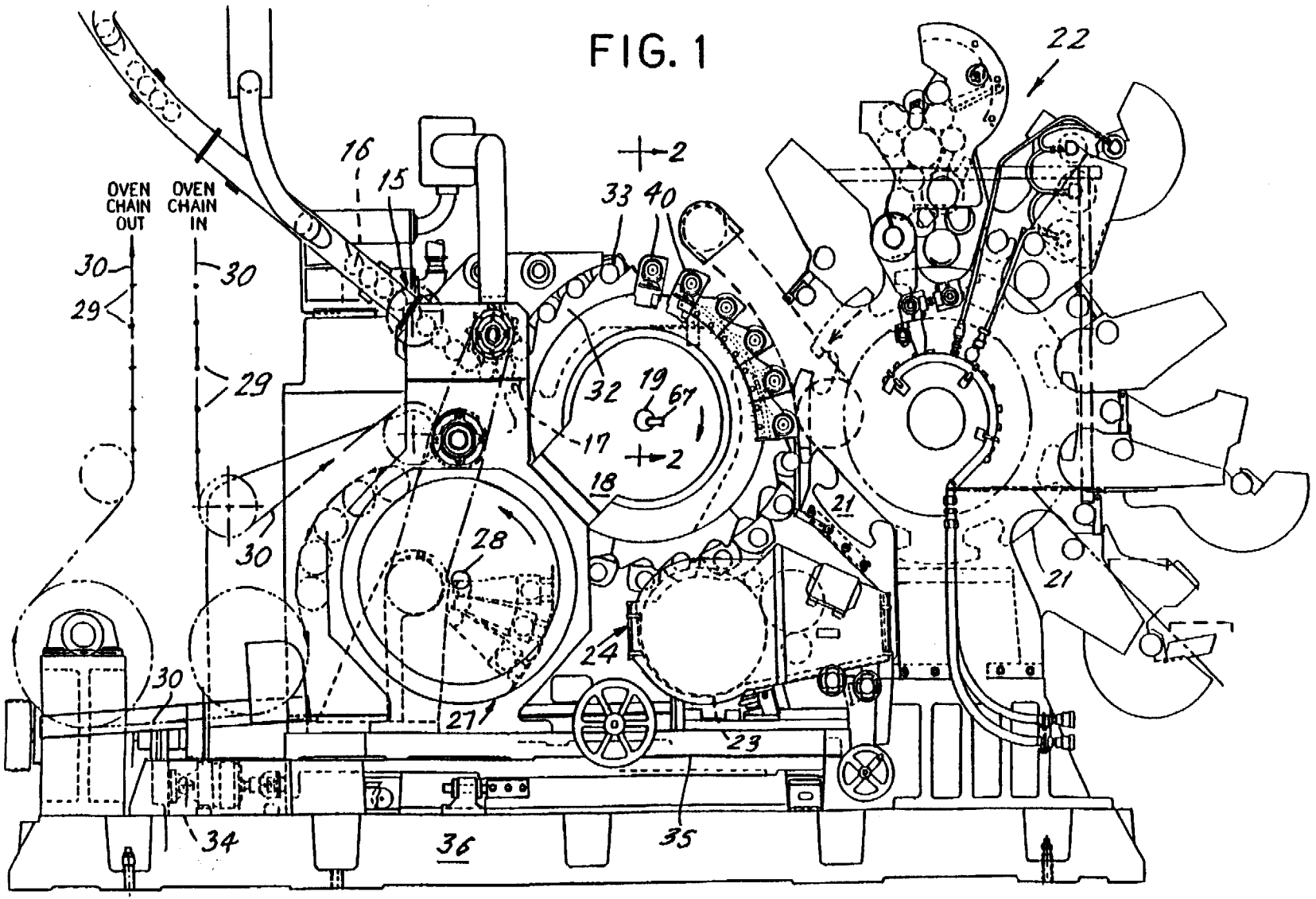
FIG. 1 is a front elevation of continuous motion can decorating apparatus that includes a spindle disc assembly constructed in accordance with teachings of the instant invention.
Figure 2:
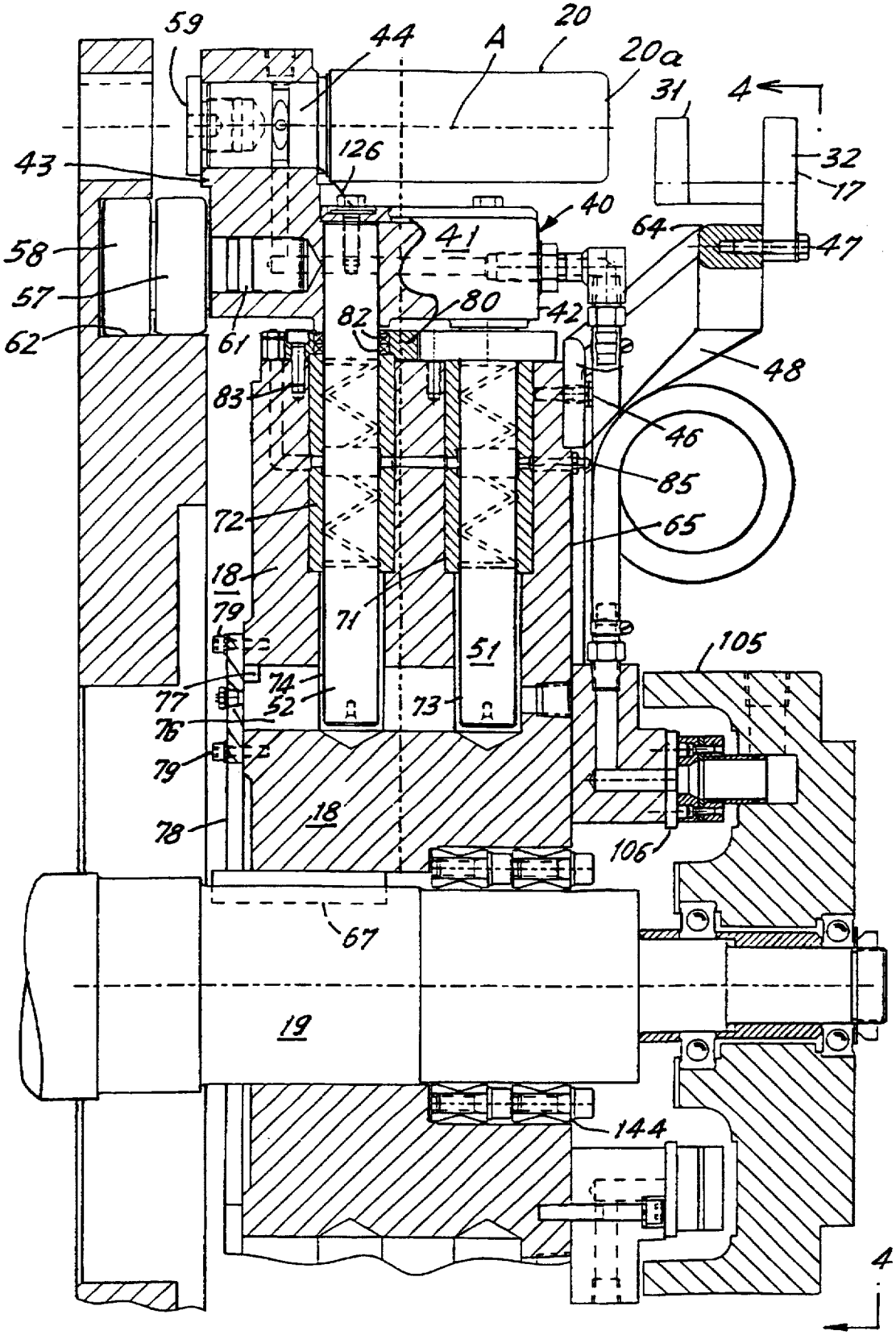
FIG. 2 is a fragmentary cross-section of the spindle disc assembly taken through line 2—2 of FIG. 1 looking in the direction of arrows 2—2.

Now referring to the Figures and more particularly to FIG. 1 which illustrates continuous motion cylindrical container decorating apparatus of the general type described in the aforesaid U.S. Pat. No. 3,766,851 and U.S. Pat. No. 5,111,742. The apparatus of FIG. 1 includes infeed conveyor chute 15 which receives undecorated containers in the for of cans 16, each open at one end thereof, from a supply (not shown) and places cans 16 in arcuate cradles or pockets 17 formed by aligned depressions in the outer edges of spaced rings 31, 32 (FIG. 2). The latter are fixedly secured to disc-like spindle carrier 18 which is keyed to horizontal drive shaft 19. A fixture comprising concentric rings 45 and 64 spaced by angled standoffs 48 is interposed between pocket rings 31, 32 and carrier 18. Bolts 46 secure ring 45 against front surface 65 of carrier 18 and bolts 47 mount pocket rings 31, 32 on ring 64. The latter is of larger diameter than ring 45 and is positioned forward thereof.

Horizontally extending spindles or mandrels 20 (FIG. 2) are also mounted to carrier 18, with each mandrel 20 being in spaced horizontal alignment with an individual pocket 17 while passing through a short region extending downstream from infeed conveyor 15. In this short region, undecorated cans 16 are moved horizontally rearward by a deflector (not shown), being transferred from each cradle 17 to an individual mandrel 20. Suction applied through an axial passage extending to the outboard or front end 20*a* of mandrel or spindle 20 draws container 16 rearward (to the left with respect to FIG. 2) to final seating position on spindle 20.

While mounted on mandrels 20, cans 16 are decorated by being brought into engagement with continuously rotating image transfer mat or blanket 21 of the multicolored printing press decorating section indicated generally by reference numeral 22. Thereafter, and while mounted to mandrels 20, each decorated can 16 is coated with a protective film of varnish applied thereto by engagement with the periphery of applicator roll 23 in the overvarnish unit indicated generally by numeral 24. Cans 16 with decorations and protective coatings thereon are then transferred from spindles 20 to suction cups (not shown) mounted near the periphery of transfer wheel 27 while the latter rotates about shaft 28 as a center. Cans 16 carried by transfer wheel 27 are deposited on generally horizontal pins 29 which project from chain type output conveyor 30 that carries cans 16 through a curing oven (not shown).

By the time spindle 20 moves beyond the downstream end of chute 15 and is in the proximity of sensor 33, each spindle 20 should be properly loaded with a can 16. If sensor 33 detects that a spindle 20 is unloaded or is not properly loaded, then before this particular spindle 20 enters the decorating zone wherein printing blanket 21 normally engages can 16 on mandrel 20, this unloaded or misloaded spindle 20 is moved to a tripped or "no-print" position. As a tripped mandrel 20 moves through the decorating zone it will be spaced from the periphery of blanket 21. This no-print position is achieved by controlling double acting cylinder 34 to trip subframe 35 having spindle carrier shaft 19 mounted thereon, by moving subframe 35 to the left with respect to FIG. 1 while main base 36, to which printing unit 22 is mounted, remains stationary. Further, actuation of sensor 33 causes overvarnish unit 24 to move downward with respect to spindle carrying shaft 19 so that the tripped spindles 20 do not engage overvarnish application roll 23.

Figure 3:
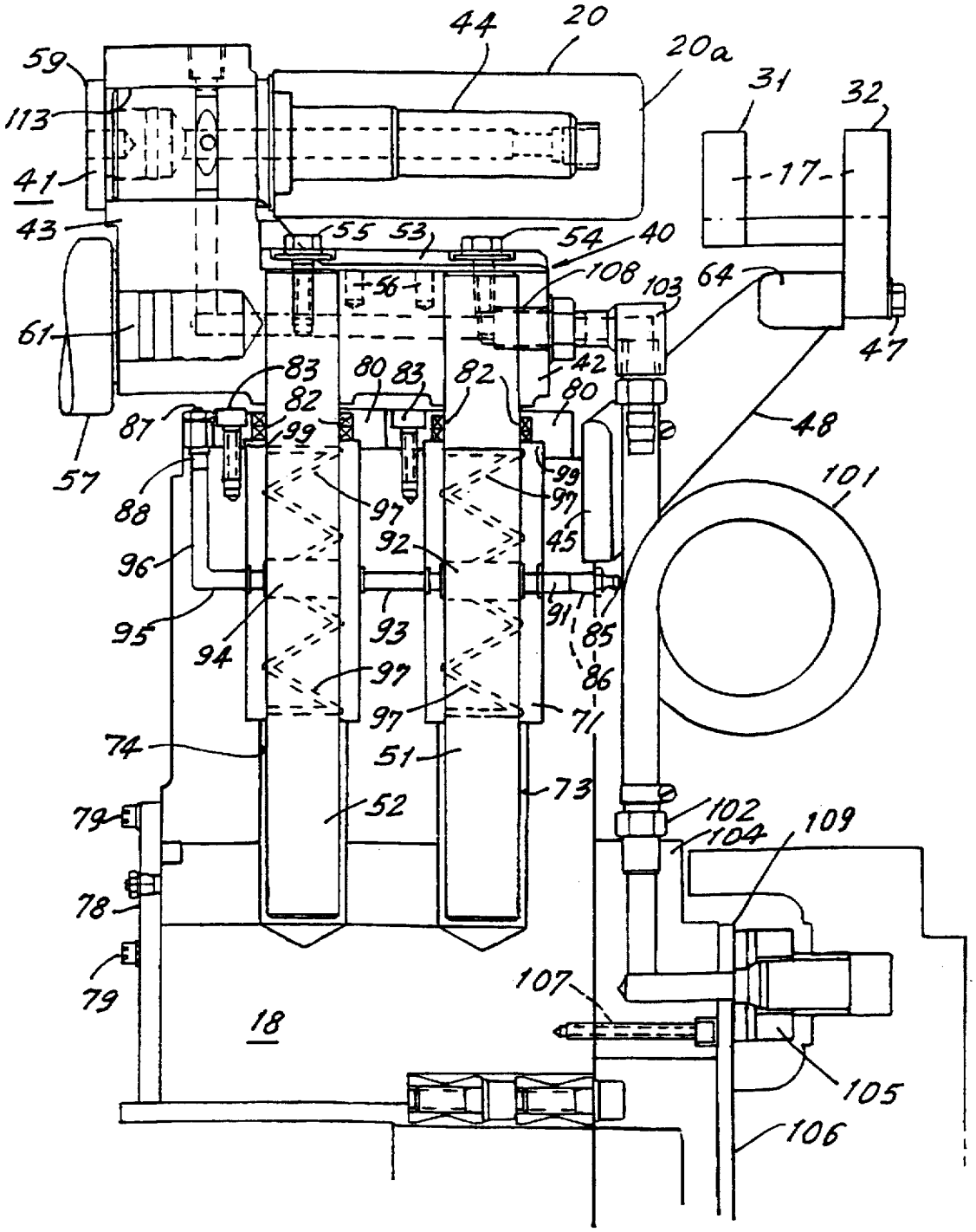
FIG. 3 is a view similar to FIG. 2 wherein, for the sake of clarity, certain elements are removed and other elements are made more prominent.
Figure 9:
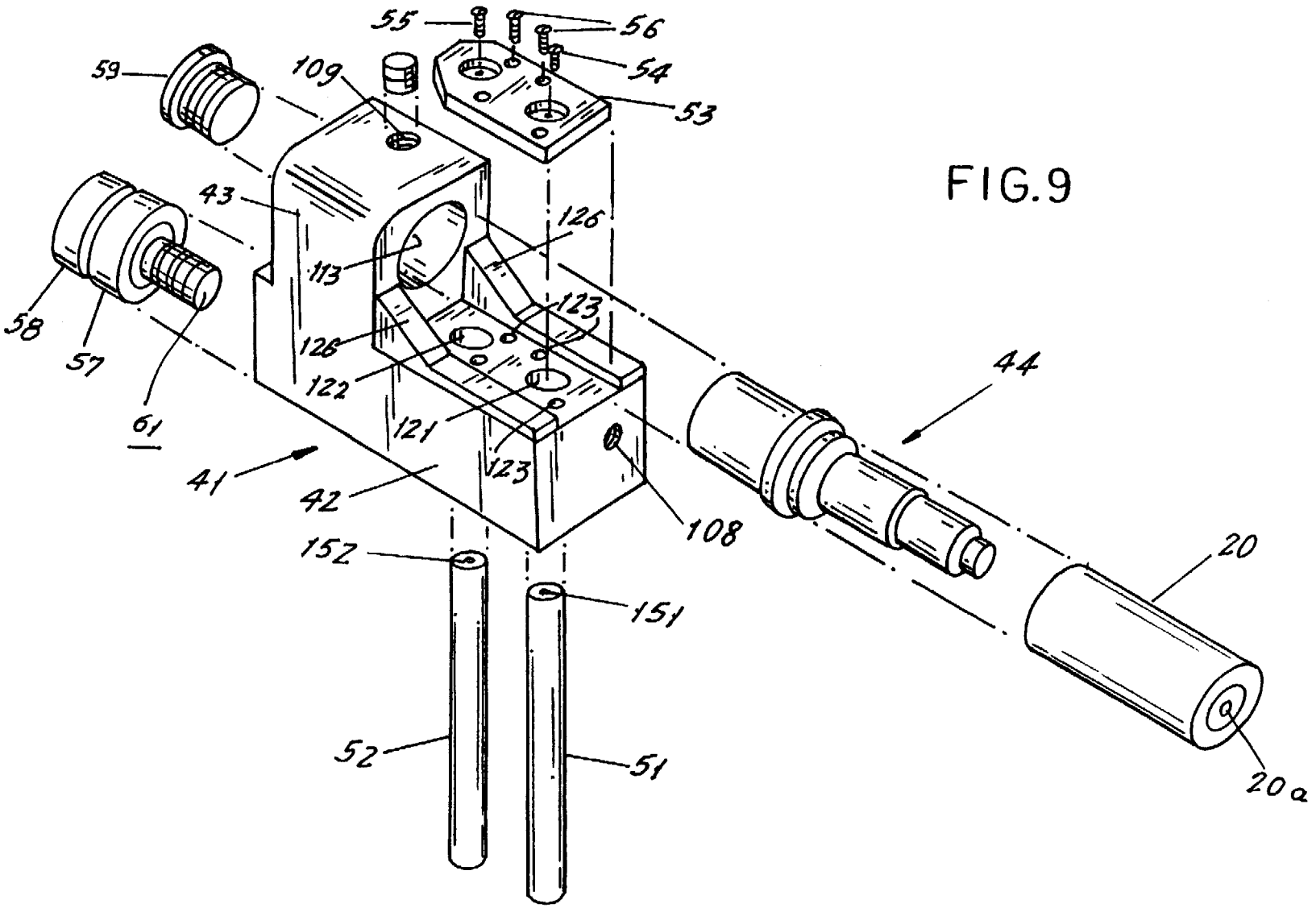
FIG. 9 is an exploded perspective of a spindle assembly.
Figure 12:
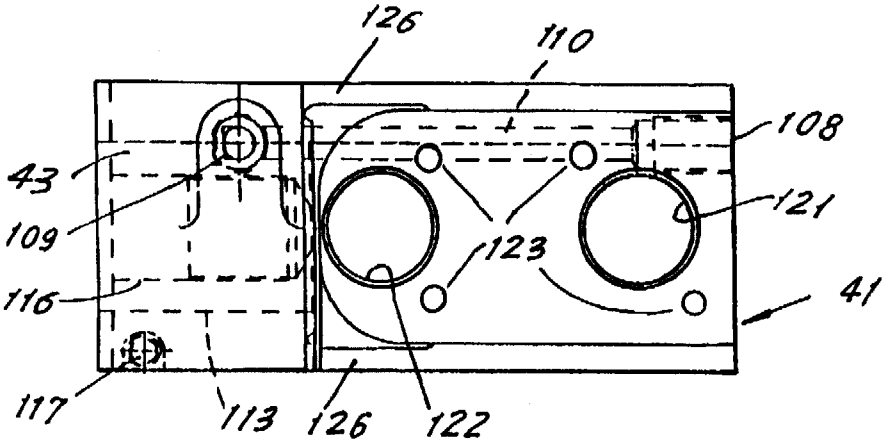
FIG. 12 is an elevation looking in the direction of arrows 12—12 of FIG. 11.
Figure 10:
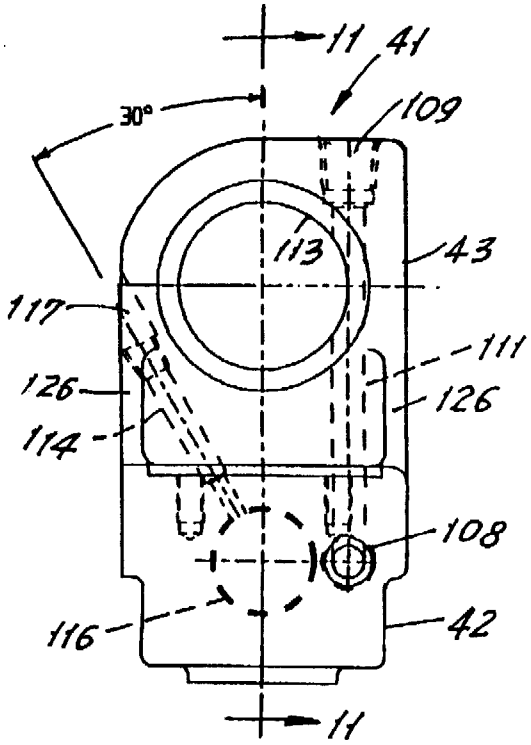
FIG. 10 is a front elevation of the spindle assembly base looking in the direction of arrow 10 of FIG. 9.
Figure 11:
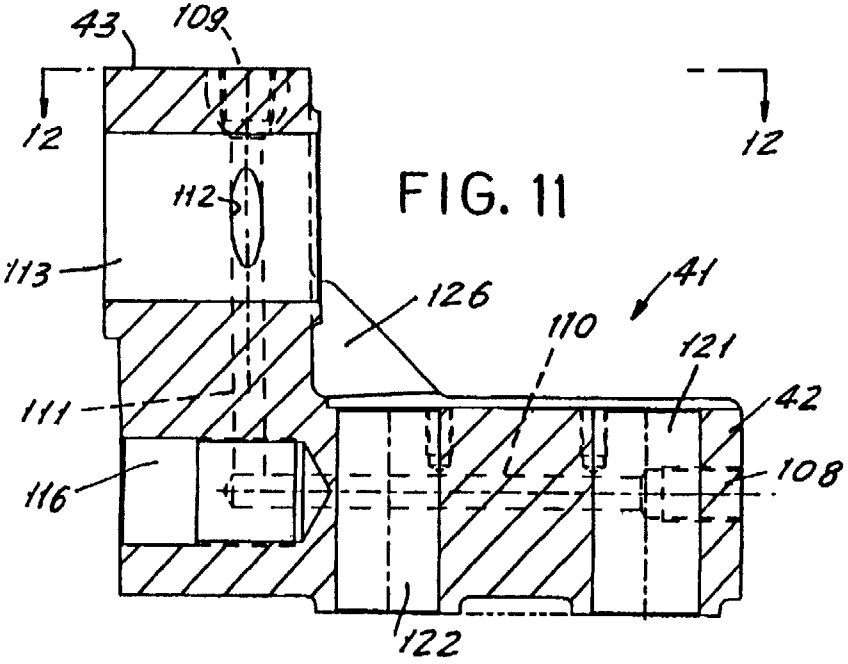
FIG. 11 is a cross-section taken through line 11—11 of FIG. 10 looking in the direction of arrows 11—11.

Spindle 20 is part of spindle subassembly 40 (FIG. 9) that also includes L-shaped base 41, stub shaft 44, two guide rods 51, 52 and two cam follower rollers 57, 58. In side elevation (see FIGS. 11 and 13), base 41 includes horizontal main section 42 and arm 43 that projects radially outward from main section 42, being at the rear thereof and perpendicular thereto (FIG. 3). Guide rods 51, 52 extend radially inward from main section 42 being secured by respective bolts 54, 55 that extend through apertures in plate 53 and are received by threaded apertures 151, 152 at the radially outward ends of respective rods 51, 52. Four bolts 56 extend through holes in plate 53 and are threadably received by apertures 123 in base 41 to secure plate 53 against the radially outward surface of main section 42. Retainer 59 at the rear of arm 43 secures spindle supporting shaft 44 so that it extends perpendicular to arm 43 in a position radially outboard of main section 42 and overlying the latter. Followers 57, 58 are rotatably mounted by retainer 61 at the rear of main section 42, and ride in closed loop cam track 62 that surrounds spindle disc shaft 19. In a manner known to the art, cooperation of cam 62 and followers 57, 58 controls the radial spacing between the rotational axes defined by parallel shafts 19 and 44.

Figure 4:
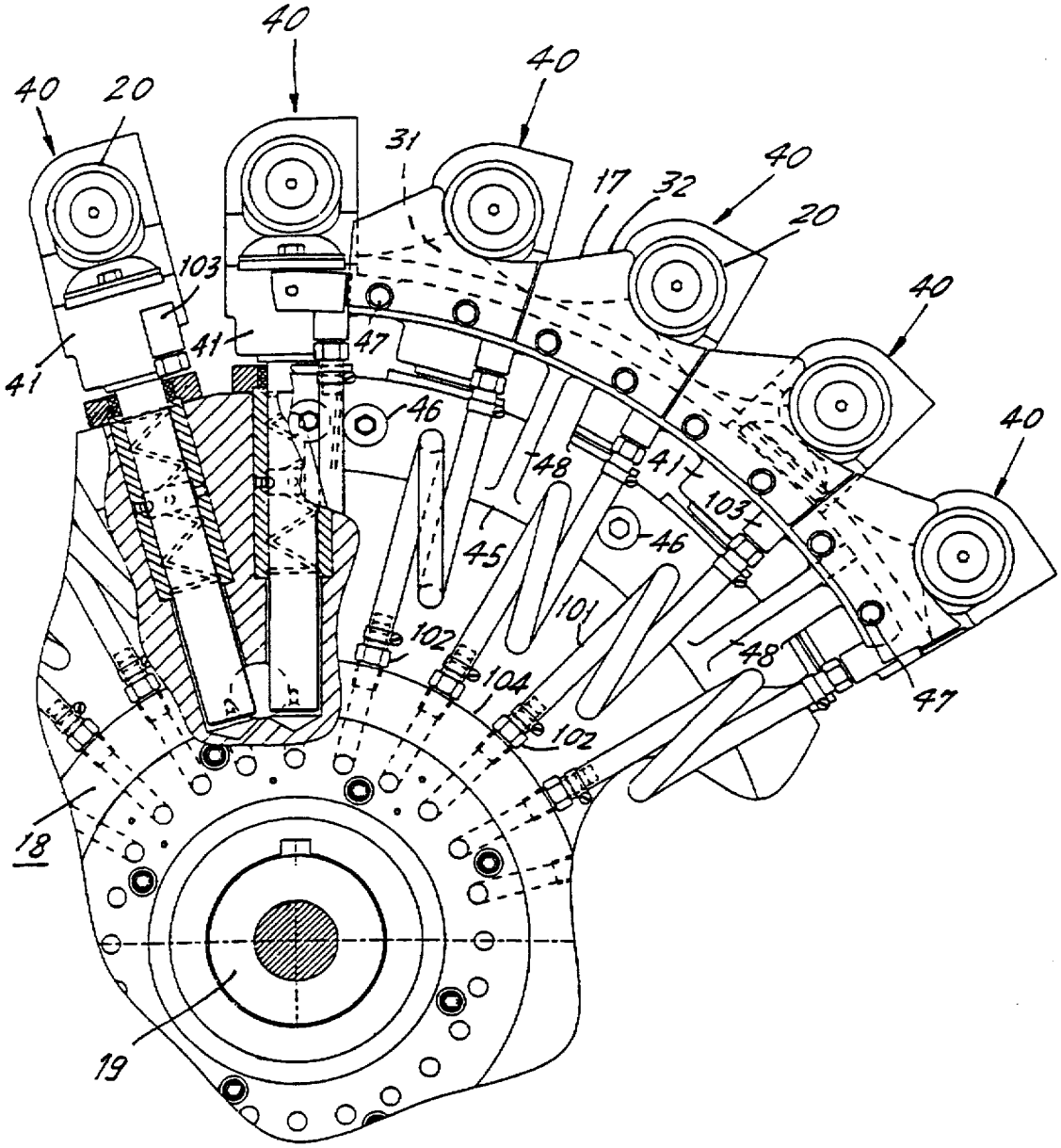
FIG. 4 is an enlarged fragmentary front elevation of the spindle disc assembly looking in the direction of arrows 4—4 of FIG. 2.
Figure 5:
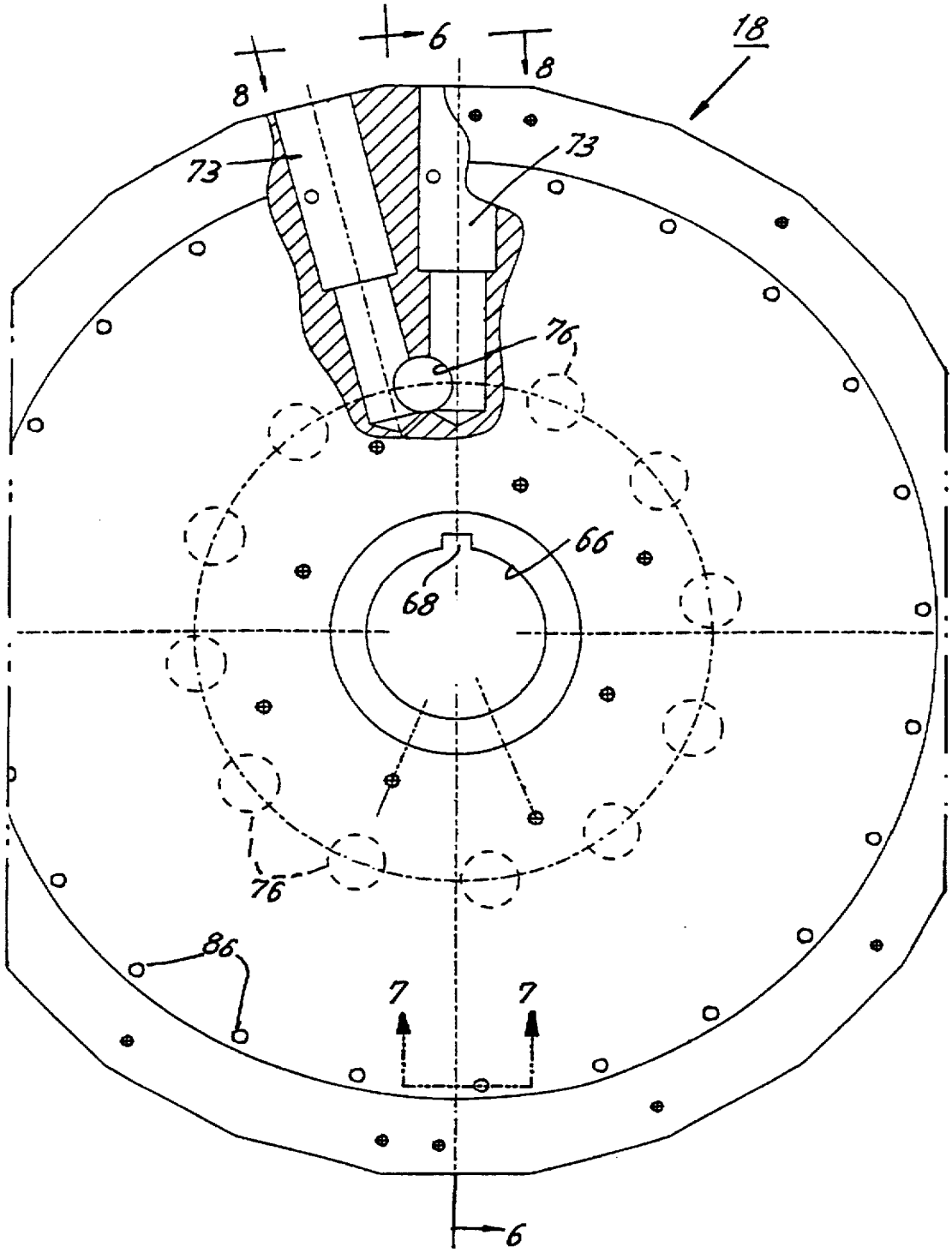
FIG. 5 is a front elevation of the spindle disc.
Figure 6:
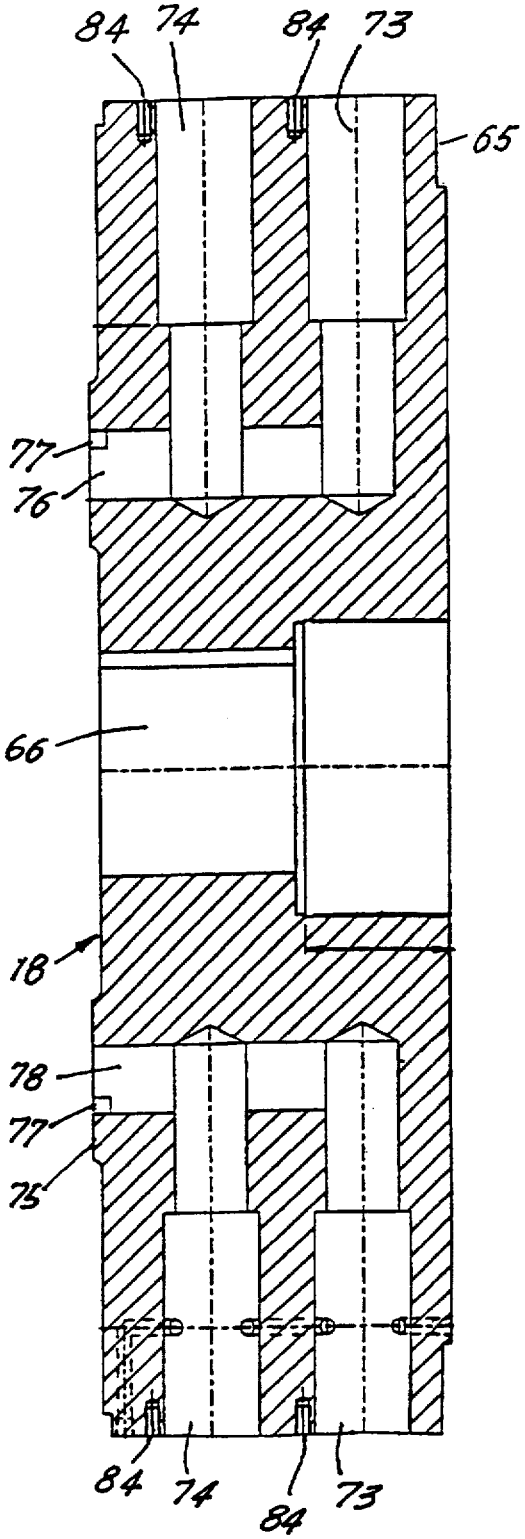
FIGS. 6 and 7 are cross-sections taken through respective lines 6—6 and 7—7 of FIG. 5 looking in the directions of the respective arrows 6—6 and 7—7.

FIGS. 5 and 6 illustrate naked spindle disc 18 that is provided with central aperture 66 which receives drive shaft 19. Key 67 (FIG. 2) is received by slot 68 (FIG. 5) in the wall defining aperture 66 to provide alignment, and the ringfeder 144 provides a driving connection and adjustment of runout between carrier shaft 19 and spindle disc 18. The latter mounts twenty-four spindle subassemblies 40 as shown partially in FIG. 4, there being equal angular spacings between the subassemblies 40. Such spacings are established by a pair of radial holes 73, 74 that extend inward from disc periphery 81 and house respective cylindrical bushings 71, 72 (FIG. 2). Reciprocating guide rods 51, 52 extend through bearing passages that are provided by the respective bushings 71, 72. Extending forward from rear surface 75 of carrier 18, and terminating short of front surface 65, are twelve axial bores 76 each of which communicates with one pair of holes 73, 74 that are at the same angular position and a second pair of holes 73, 74 that are at an adjacent angular position. Thus, each axial bore 76 intersects with four radial holes 73, 73, 74, 74 at the radially inward ends of the latter. Small cross-section circular slot 77 milled in rear surface 75 interconnects all twelve bores 76. The sizes and locations of bores 76 and slot 77 are such that they do not have a substantial effect on the strength of carrier 18. Thus, aluminum ring 78 (FIG. 3) held by bolts 79 functions only as a cover that retains grease within bores 76 and slot 77. It is not necessary for cover ring 78 to be constructed of heavyweight material that will reinforce the strength of the naked carrier 18.

Figure 8:
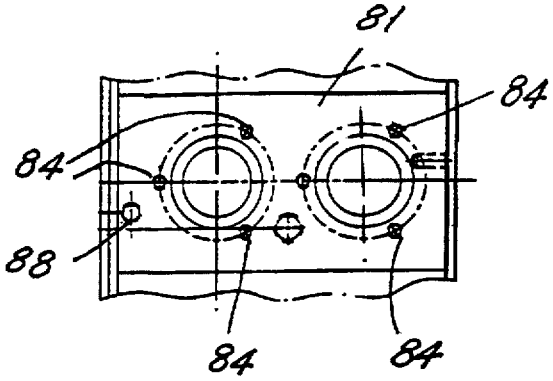
FIG. 8 is a fragmentary end view of the spindle disc looking in the direction of arrows 8—8 of FIG. 5.
Figure 7:
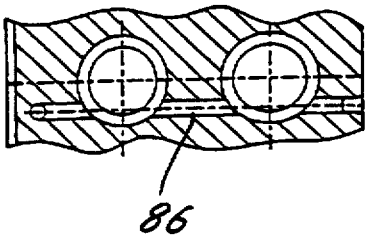

Each bushing 71, 72 is retained in a respective radial hole 73, 74 by an individual ring-like cap or holder 80 (FIG. 3). Holders 80 are at the radially outer ends of bushings 71, 72, and the radially inner ends of bushings 71, 72 rest upon interior ledges of holes 73, 74. Each holder 80 contains two ring seals 82, 82 that surround each guide rod 51, 52. Three bolts 83 that are received by apertures 84 (FIG. 8) in carrier periphery 81 secure each holder 80 to carrier 18. Piloting the upper ends of each bushing 71, 72 in annular undercut 99 at the radially inner surface of holder 80 accurately positions seals 82, 82 from beneath holder 80 relative to the bearing passages provided by bushings 71, 72 to obtain improved operation of guide rods 51, 52 as they reciprocate in the bearing passages of bushings 71, 72.

Each of the twenty-four apertures 86 (FIG. 5) in the front surface of carrier 18 receives an individual fitting 85 (FIG. 2). When this can decorating apparatus is being set-up for operation, grease injected at fitting 85 travels a circuitous path to relief fitting 87 at aperture 88 (FIG. 8) at carrier periphery 81. With particular reference to FIG. 3, it is seen that this circuitous path from fitting 85 to fitting 87 includes axial portion 91, annular cutout 92 inside of bushing 71, axial portion 93, cutout 94 inside of bushing 72, axial portion 95 and radial portion 96. The zig-zag slots 97 in the interior surfaces of bushings 71, 72 extend from cutouts 92 and 94 toward both ends of bushings 71, 72. Thus, when grease introduced at a fitting 85 appears at its associated relief fitting 87 this is a positive sign that both rods 51, 52 of a particular spindle subassembly 40 are lubricated.

As required, vacuum and pressure are supplied to forward end 20*a* of mandrel 20 through an individual flexible hose 101 having opposite ends clamped to fittings 102, 103 that are connected, respectively, to carrier 18 and spindle assembly 40. That is, straight fitting 102 is screwed into an aperture of movable valve element 104 that is secured by bolts 107 to the front side of carrier 18, and L-shaped fitting 103 is screwed into aperture 108 of base 41. Aperture 108 is at the front end of main section 42 (see FIGS. 9–14). Wear plate 106 secured to the front of movable valve member 104, is in sliding engagement with stationary valve member 105 at interface 109. In a manner known to the art, appropriate apertures in face valve members 104, 105 come into alignment at particular angular positions of carrier 18 so that at appropriate times vacuum and pressure levels that are delivered to the input side of stationary valve member 105 (side remote from valve member 104) extend through valve members 104, 105 to appear at mandrel assembly 40.

To extend the life of hose 101, fittings 102, 103 do not have parts that are free to swivel or otherwise move relative to each other once fitting 103 is secured to mandrel subassembly 40 and fitting 102 is secured to movable valve member 104. Further, hose 101 contains a complete relatively large diameter loop, and fittings 102, 103 are angularly offset so that hose 101 will not rub against itself as fitting 103 reciprocates radially. In addition, hose 101 is positioned so that it will not rub against other elements.

Main section 42 of base 41 is provided with axial passage 110 that extends rearward from aperture 108 to the radially inner end of passage 111 in arm 43. Passage 112 extends to the radially outward edge of arm 43 where the radially outward end 109 of passage 111 is plugged. Elongated opening 112 at a midpoint of passage 111 connects with arm aperture 113 which houses the rear end of mandrel shaft 44. Passages (not shown) extend from aperture 113 to connect with front end 20*a* of mandrel 20. Arm 43 is also provided with diagonal passage 114 that extends to recess 116 wherein one end of stub shaft 61 (FIG. 2) is positioned. To lubricate cam follower rollers 57, 58, grease is introduced to passage 114 at its radially outer end 117. Guide rods 51, 52 pass through apertures 121, 122 that extend radially through main section 42, and four apertures 123 in the radially outer surface of main section 42 receive bolts 56 that secure guide rod holding plate 53 to base 41.

Figure 14:
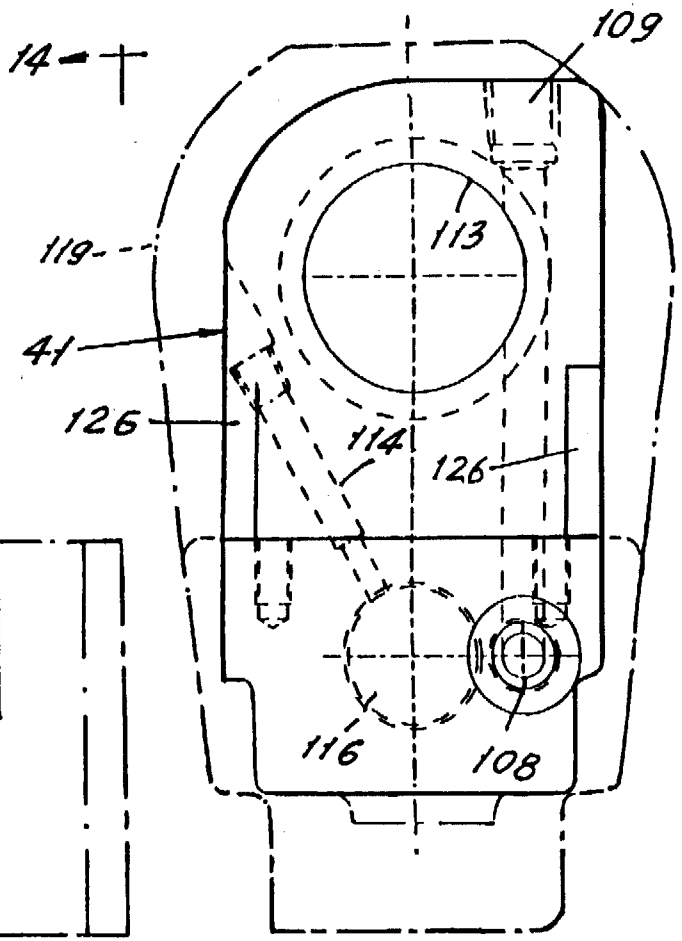
FIG. 14 is a front elevation of the elements of FIG. 13 looking in the direction of arrows 14, 14.
Figure 13:
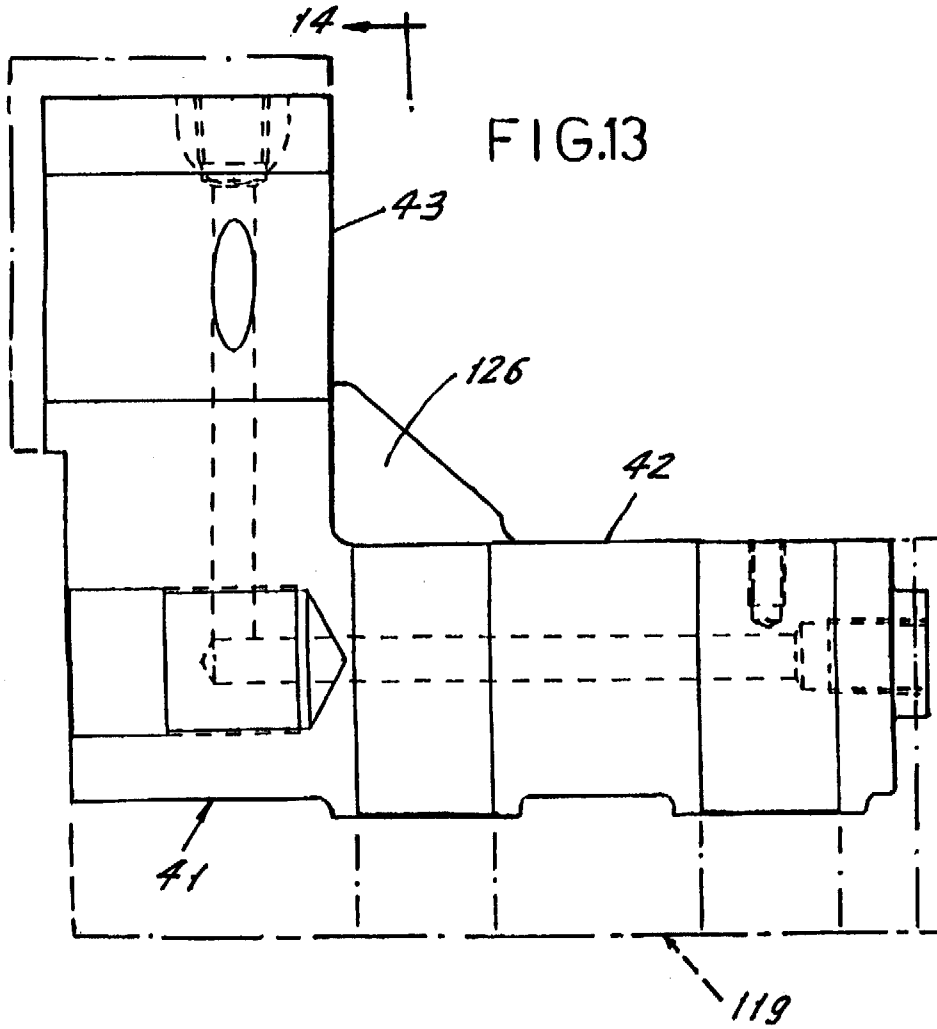
FIG. 13 is a side elevation which shows a size comparison between the spindle assembly base of the instant invention and that prior art base which is replaced by the base of the instant invention.

Base 41 weighs considerably less than prior art base 119 shown by the phantom outline in FIGS. 13 and 14, and other mandrel support bases that can be replaced by base 41. That is, base 41 does not include the sections between the solid line and phantom outline in FIGS. 13 and 14, whereas prior art base 119 includes those sections plus substantially the entire base 41. It is noted that for base 41, resistance to bending between arm 43 and main section 42 is maintained at a satisfactory level by thin triangular gussets 126 (FIG. 9) which provide reinforcement at each side of arm 43 where it joins main section 42.

Not only is base 41 light in weight, but main section 42 is relatively thin so that the rotational axis of mandrel 20, located at center A (FIG. 2) of cantilevered shaft 44 can be relatively close to the radially outward ends of bushings 71, 72. This serves to reduce the bending moments that act upon guide shafts 51, 52 and translate into bending forces that cause rapid wear of bushings 71, 72 in prior art constructions.

In a practical embodiment of apparatus constructed according to the instant invention for decorating two piece cans, where mandrel 20 has an approximate diameter of 2.6 inches, the radially measured spacing between rotational axis A for mandrel 20 and the radially outer ends of bushings 71, 72 is as little as 5.2 inches, with cam slot 62 being shaped and positioned so that for each revolution of mandrel carrier 18 axis A travels through a radial stroke of 3 inches.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Continuous motion apparatus for decorating cylindrical containers, said apparatus comprising a decorating section and a transport section that carries containers through a decorating zone where decorations are applied to the containers, said transport section including:

a carrier continuously rotating on a carrier axis, a plurality of spindle subassemblies mounted on said carrier along its periphery with equal angular spacings between adjacent ones of said subassemblies, said subassemblies being mounted to reciprocate radially relative to said carrier axis as a center;

each of said subassemblies including an L-shaped base, a spindle mounted on said base for rotation about a spindle axis that is parallel to said carrier axis, said base including a main section parallel to said spindle axis and an arm extending radially outward from said main section at its rear end, said spindle being on a cantilevered support that projects forward from said arm and overlies said main section, at least one guide rod extending radially inward from said main section with each guide rod of said at least one guide rod being received in a radially extending bearing passage of an individual bushing that is fixedly mounted to said carrier, with said bearing passage being open at said periphery of said carrier;

an associated washer-like retaining cap for each of said bushings, each of said retaining caps containing a grease sealing ring and being secured to said carrier at said periphery in operative position to block radially outward movement of said associated bushing;

each of said bushings having a radially outward end that extends into an undercut portion in said cap whereby said cap is piloted on said bushing that is associated with said cap.

2. Continuous motion apparatus for decorating cylindrical containers, said apparatus comprising a decorating section and a transport section that carries containers through a decorating zone where decorations are applied to the containers, said transport section including:

a carrier continuously rotating on a carrier axis, a plurality of spindle subassemblies mounted on said carrier along its periphery with equal angular spacings between adjacent ones of said subassemblies, said subassemblies being mounted to reciprocate radially relative to said carrier axis as a center;

each of said subassemblies including an L-shaped base, a spindle mounted on said base for rotation about a spindle axis that is parallel to said carrier axis, said base including a main section parallel to said spindle axis and an arm extending radially outward from said main section at its rear end, said spindle being on a cantilevered support that projects forward from said arm and overlies said main section, at least first and second guide rods extending radially inward from said main section and being received in respective first and second radially extending bearing passages of respective first and second bushings that are fixedly mounted to said carrier, with said bearing passages being open at said periphery of said carrier;

said first and second bushings being disposed in individual radial passages extending radially inward from said periphery of said carrier, said first rod being forward of said second rod;

a plurality of grease reservoirs each of which is formed by a transverse passage extending forward from a rear surface of said carrier and intersecting radially inner ends of first, second, third and fourth of said radial passages which receive said first and second guide rods of a first of said assemblies as well as said first and second guide rods of a second of said assemblies, with said first and said second subassemblies being adjacent to each other.

3. Apparatus for decorating cylindrical containers as defined by claim 2 in which said transverse passages are connected by an annular slot in said rear surface, said slot having a relatively small cross-sectional area as compared to a cross-sectional area of each of said transverse passages.

4. Apparatus for decorating cylindrical containers as defined by claim 3 in which said inlets are accessible at said front surface of said carrier and said outlets are located at said periphery of said carrier.

5. Apparatus for decorating cylindrical containers as defined by claim 4 in which the carrier has a front surface opposite said rear surface;

an individual grease inlet associated with each of said subassemblies and an individual grease relief outlet associated with each of said subassemblies; said inlets and said outlets being on said carrier;

for each of said subassemblies its said associated inlet and outlet being connected by a grease passage that includes interfaces between said rods of said associated assembly and said bushings into which said rods extend, with said inlet being in front of said first rod and said outlet being behind said second rod.

6. Apparatus for decorating cylindrical containers as defined by claim 3 in which the carrier has a front surface opposite said rear surface; an individual grease inlet associated with each of said subassemblies and an individual grease relief outlet associated with each of said subassemblies;

said inlets and said outlets being on said carrier;

for each of said subassemblies its said associated inlet and outlet being connected by a grease passage that includes interfaces between said rods of said associated assembly and said bushings into which said rods extend, with said inlet being in front of said first rod and said outlet being behind said second rod.

7. Apparatus for decorating cylindrical containers as defined by claim 2 in which the carrier has a front surface opposite said rear surface; an individual grease inlet associated with each of said subassemblies and an individual grease relief outlet associated with each of said subassemblies; said inlets and said outlets being on said carrier; for each of said subassemblies its said associated inlet and outlet being connected by a grease passage that includes interfaces between said guide rods of said associated assembly and said bushings into which said guide rods extend, with said inlet being in front of said first rod and said outlet being behind said second rod.

8. Apparatus for decorating cylindrical containers as defined by claim 2 in which there are thin gussets at opposite sides of said main section at said rear end and extending between said main section and said arm to stiffen said base whereby said base effectively resists bending when a radially inward force is applied to said spindle during decorating of a container being carried by said spindle.

9. Apparatus for decorating cylindrical containers as defined by claim 8 wherein with said spindle having a diameter of approximately 2.6", and while decorations are being applied to a container that is mounted on said spindle, spacing between said spindle axis and said bushings is as little as approximately 5.2".

10. Apparatus for decorating cylindrical containers as defined by claim 2 in which for each of said subassemblies there is a flexible hose having a first end connected to said main section at its front end to supply vacuum and pressurized air selectively to said spindle, said hose having a second end connected to a movable valve section mounted on said carrier and in operative engagement with a stationary valve section to which vacuum and pressurized air are supplied;

said hose defining at least one complete loop which expands as said spindle axis moves toward said carrier axis.

11. Apparatus for decorating cylindrical containers as defined by claim 10 in which said first end of said hose is offset angularly from said second end of said hose.

12. Apparatus for decorating cylindrical containers as defined by claim 11 in which there is a first air fitting connecting said hose to said main section of said base and a second air fitting connecting said hose to said movable valve section;

said first and said second air fittings being constructed so that while said carrier is rotating all elements of said first air fitting are fixed with respect to each other and with respect to said base and all elements of said second air fitting are fixed with respect to each other and with respect to said carrier.

13. Apparatus for decorating cylindrical containers as defined by claim 10 wherein with said mandrel having a diameter of approximately 2.6", and while decorations are being applied to a container that is mounted on said mandrel, spacing between said mandrel axis and said bushings is as little as approximately 5.2".

14. Apparatus for decorating cylindrical containers as defined by claim 2 in which there is an associated washer-like retaining cap for each of said bushings, each of said retaining caps containing a grease sealing ring and being secured to said carrier at said periphery in operative position to block radially outward movement of said associated bushing;

each of said bushings having a radially outward end that extends into an undercut portion in said cap whereby said cap is piloted on said bushing that is associated with said cap.

15. Continuous motion apparatus for decorating cylindrical containers, said apparatus comprising a decorating section and a transport section that carries containers through a decorating zone where decorations are applied to the containers, said transport section including:

a carrier continuously rotating on a carrier axis, a plurality of spindle subassemblies mounted on said carrier along its periphery with equal angular spacings between adjacent ones of said subassemblies, said subassemblies being mounted to reciprocate radially relative to said carrier axis as a center;

each of said subassemblies including an L-shaped base, a spindle mounted on said base for rotation about a spindle axis that is parallel to said carrier axis, said base including a main section parallel to said spindle axis and an arm extending radially outward from said main section at its rear end, said spindle being on a cantilevered support that projects forward from said arm and overlies said main section, first and second guide rods extending radially inward from said main section and being received in respective first and second radially extending bearing passages of respective first and second bushings that are fixedly mounted to said carrier, with said bearing passages being open at said periphery of said carrier;

said first and second bushings being disposed in individual radial passages extending radially inward from said periphery of said carrier, said first rod being forward of said second rod;

and thin gussets at opposite sides of said base at said rear end of said main section;

said gussets extending between said main section and said arm to stiffen said base whereby said base effectively resists bending when a radially inward force is applied to said spindle during decorating of a container being carried by said spindle.

16. Apparatus for decorating cylindrical containers as defined by claim 13 wherein with said spindle having a diameter of approximately 2.6", and while decorations are being applied to a container that is mounted on said spindle, spacing between said spindle axis and said bushings is as little as approximately 5.2".

17. Apparatus for decorating cylindrical containers as defined by claim 15 in which for each of said subassemblies there is a flexible hose having a first end connected to said main section at its front end to supply vacuum and pressurized air selectively to said spindle, said hose having a second end connected to a movable valve section mounted on said carrier and in operative engagement with a stationary valve section to which vacuum and pressurized air are supplied;

said hose defining at least one complete loop which expands as said spindle axis moves toward said carrier axis.

18. Continuous motion apparatus for decorating cylindrical containers, said apparatus comprising a decorating section and a transport section that carries containers through a decorating zone where decorations are applied to the containers, said transport section including:

a carrier continuously rotating on a carrier axis, a plurality of spindle subassemblies mounted on said carrier along its periphery with equal angular spacings between adjacent ones of said subassemblies, said subassemblies being mounted to reciprocate radially relative to said carrier axis as a center;

each of said subassemblies including an L-shaped base, a spindle mounted on said base for rotation about a spindle axis that is parallel to said carrier axis, said base including a main section parallel to said spindle axis and an arm extending radially outward from said main section at its rear end, said spindle being on a cantilevered support that projects forward from said arm and overlies said main section, first and second guide rods extending radially inward from said main section and being received respective first and second radially extending bearing passages of respective first and second bushings that are fixedly mounted to said carrier, with said bearing passages being open at said periphery of said carrier;

a flexible hose having a first end connected to said main section at its front end to supply vacuum and pressurized air selectively to said spindle, said hose having a second end connected to a movable valve section mounted on said carrier and in operative engagement with a stationary valve section to which vacuum and pressurized air are supplied;

said hose defining at least one complete loop which expands as said spindle axis moves toward said carrier axis and contracts as the spindle axis moves away from said carrier axis.

19. Apparatus for decorating cylindrical containers as defined by claim 18 in which said first end of said hose is offset angularly from said second end of said hose.

20. Apparatus for decorating cylindrical containers as defined by claim 19 in which there is a first air fitting connecting said hose to said main section of said base and a second air fitting connecting said hose to said movable valve section;

said first and said second air fittings being constructed so that while said carrier is rotating all elements of said first air fitting are fixed with respect to each other and with respect to said base and all elements of said second air fitting are fixed with respect to each other and with respect to said carrier.

* * * * *